United States Patent [19]

Rochat

[11] 4,136,514

[45] Jan. 30, 1979

[54] ELECTRO-MECHANIC CALENDAR TIMEPIECE

[75] Inventor: Daniel Rochat, Saint-Blaise, Switzerland

[73] Assignee: Ebauches S.A., Canton of Neuchatel, Switzerland

[21] Appl. No.: 796,768

[22] Filed: May 13, 1977

[30] Foreign Application Priority Data

May 24, 1976 [CH] Switzerland ..... 6516/76

[51] Int. Cl.[2] ..... G04B 19/24

[52] U.S. Cl. ..... 58/58

[58] Field of Search ..... 58/5, 58, 59

[56] References Cited

U.S. PATENT DOCUMENTS

| | | | |
|---|---|---|---|
| 3,738,097 | 6/1973 | Vuilleumier | 58/58 |
| 3,882,669 | 5/1975 | Jakob | 58/58 |

*Primary Examiner*—James R. Scott
*Assistant Examiner*—Vit W. Miska
*Attorney, Agent, or Firm*—Silverman, Cass & Singer Ltd.

[57] ABSTRACT

An electro-mechanic calendar timepiece includes a braking device for generating torque to prevent drifting or floating of the movement gearing when the intermittent calendar driving mechanism is not rotating. When the calendar driving mechanism is rotating the braking device is not operating and the calendar driving mechanism cooperates with a lever arm and spring to generate torque to prevent the floating of the movement gearing.

5 Claims, 5 Drawing Figures

ELECTRO-MECHANIC CALENDAR TIMEPIECE

BACKGROUND OF THE INVENTION

The present invention relates to an electro-mechanic calendar timepiece.

In the electro-mechanic timepieces, the gearing of the movement can float or drift, that has for consequence, especially, that the seconds hand is floating too, due to the fact that this gearing is not submitted to the action of an antagonist torque applied to one of its end, as it is the case of the gearings of the mechanic watches ending by an escapement device.

In the calendar electro-mechanic watches, the driving mechanism of the calendar, when it is not at rest, produces on the gearing an antagonist torque which prevents this undesired floating. Now, in such watches, and even in the case where the calendar indicator, for instance the date indicator, goes step by step instantaneously, that necessitates that the winding of a driving spring be effected during a period of time extending on several hours, there is always a period of some hours during which the driving mechanism of the calendar indicator is at rest and does not apply, consequently, any antagonist torque on the gearing of the movement. The floating of this gearing and, consequently, the corresponding floating of the seconds hand, which is the only one practically visible, is produced during this period.

The object of the present invention is to prevent this drawback.

The invention is applied to a calendar timepiece in which the driving mechanism of at least one indicating member of the calendar, by the motor of the timepiece, is generator of an antagonist torque preventing the floating of the gearing of the movement, this timepiece being characterized by the fact that it comprises a braking device acting on the gearing when the driving mechanism of the indicating member is at rest, so as to produce then an antagonist torque which is substituted to the antagonist torque due to the said mechanism, this braking device being controlled by the even mechanism driving mechanism of the calendar indicating member, so that its action be exactly synchronised with this latter.

BRIEF DESCRIPTION OF THE DRAWINGS

The drawing shows, by way of example, one embodiment of the object of the invention.

DESCRIPTION OF THE PREFERRED EMBODIMENT

Figure 1:
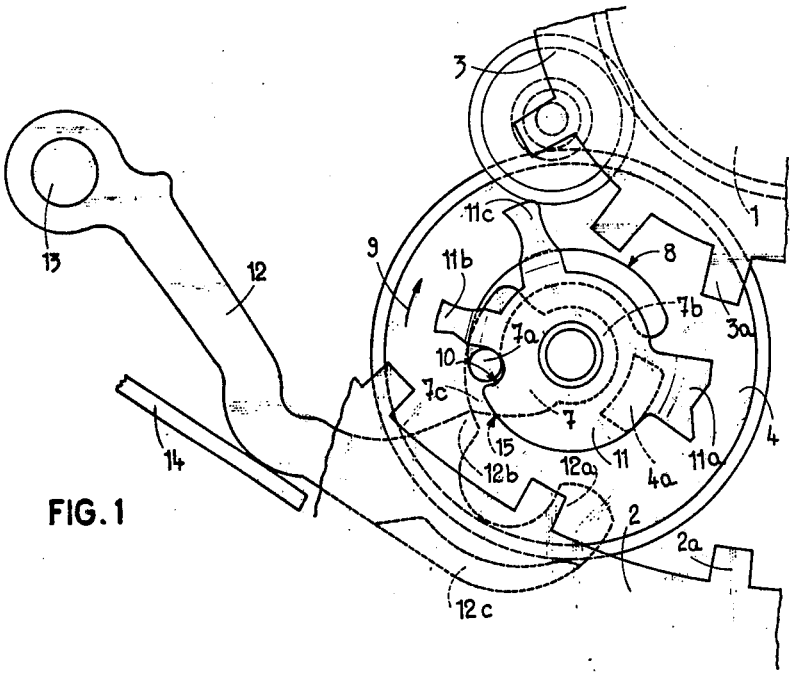
FIGS. 1 to 3 are plan views of a driving mechanism of the date and days indicators of a calendar watch in three different working positions.

The gearing of the present watch, only one element of which has been represented, that is to say the hours wheel 1 making one revolution per 12 hours, drives, in view of the driving of a date indicator 2 and of a days indicator 3, partially represented, a wheel 4 making one revolution per 24 hours.

Figure 4:
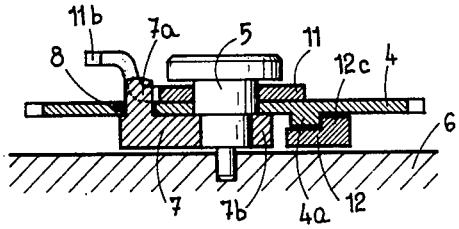
FIG. 4 is a sectional view along line IV—IV of FIG. 3.

The wheel 4 is rotatably mounted on a journal 5 (FIG. 4) carried by the frame of the movement, diagrammatically representated at 6; it is coaxial to a cam

7 presenting a protrusion 7*a* having the shape of a pin, passing through an elongated aperture 8 of the wheel. This mechanism, of the type called "surprise", has for effect that, when the wheel 4 rotates, in the direction of the arrow 9, the cam 7 is driven by its protrusion 7*a* which then is situated at the rear end of the elongated aperture 8, while being able, if necessary, to take advance on this wheel, the protrusion 7*a* running then along the aperture.

The protrusion 7*a* of the cam 7 is engaged in a radial notch 10 provided in a driving member 11 loosly mounted on the journal 5, so that the cam 7 and the member 11 are angularly rigid with each other. The member 11 is provided with three fingers 11*a*, 11*b* and 11*c* bent out of its plane one of which, that is to say finger 11*b*, is visible in FIG. 4. The finger 11*a* cooperates, once per rotation of the member 11, with an inner toothing 2*a* of the date indicator 2 for driving it, while the fingers 11*b* and 11*c* cooperate, also once per revolution, with a toothing 3*a* of the days indicator 3, also for driving it.

The cam 7 acts on a control lever 12, articulated at 13 on the frame of the movement, and which is submitted to the action of a spring 14 urging it to be applied against the cam. This lever 12 is provided with a fork shaped portion the two arms 12*a* and 12*b* of which cap, when the mechanism is at rest, a circular portion 7*b* of the cam 7. The active portion of the cam has the shape of an ear which, once per revolution, engages the arm 12*a* of the lever 12 for lifting this lever, against the action of the spring 14, which is then wound up, for sliding then on this arm 12*a* and passing, before having left it, on the arm 12*b*, and sliding thereon until the terminal portion 7*c* of the ear of the cam leaves this arm 12*b*. This arm acts then on the lateral face, designated by 15, of the ear of the cam for pushing it ahead, in an instantaneous step, during which the control finger 11*a*, 11*b* and 11*c* operate the date indicator 2 and the days indicator 3 which are then driven in an instantaneous step.

Figure 2:
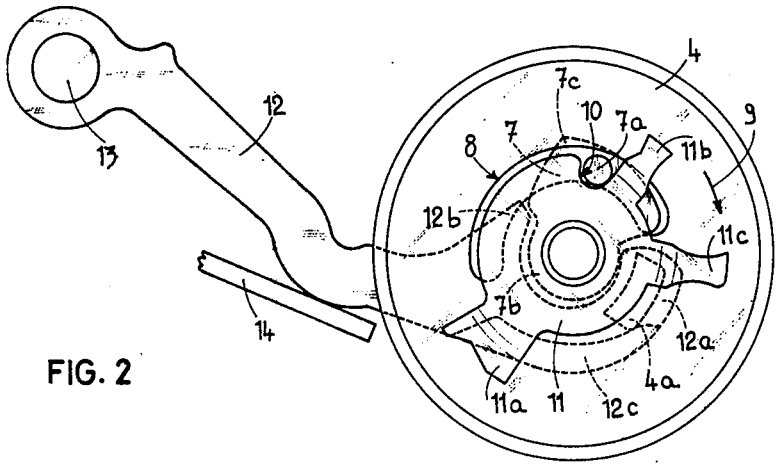
Figure 3:
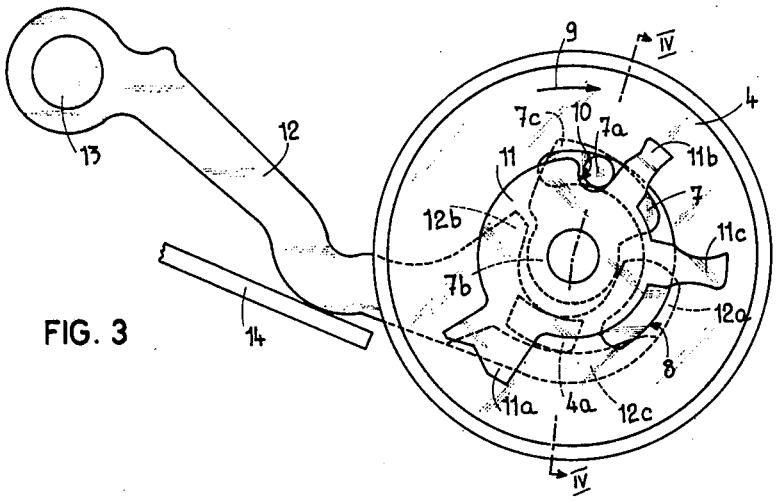
Figure 5:
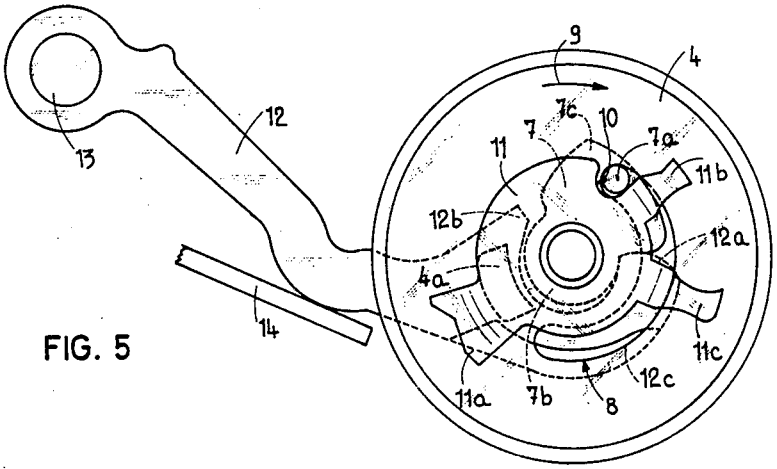
FIG. 5 is a plan view of this mechanism, similar to this of FIGS. 1 to 3, in a fourth working position.

The several steps of this processus have been representated in FIGS. 1 to 5:

In FIG. 1, the mechanism is represented in the position it occupies just before the portion 7*c* of the cam 7 passes over the arm 12*b* of the lever 12, FIG. 2 shows the mechanism just after this overpassing has occured, the lever 12, under the effect of the spring 14, previously wound up, having advanced the cam 7, as disclosed hereabove. FIG. 3 illustrates the mechanism when the cam 7 is stationary, the wheel 4 continuing its advance. FIG. 5 illustrates the position in which the cam is again driven, its protrusion 7*a* having been joined by the rear end of the elongated aperture 8 of the wheel 4, in which position this protrusion enters in contact with the arm 12*a* of the lever 12, that produces the beginning of the winding of the spring 14.

As it can be seen, the lever 12 exerts a torque on the cam 7 on the most part of the rotation of the wheel 4, under the action of the spring 14, thus preventing any floating of the gearing. However, between the positions of FIGS. 2 and 3, the cam is stationary so that this torque disappears then.

So as to maintain, during this time, a torque on the gearing, the wheel 4 is provided, on its face against which is applied the cam 7, with a protrusion 4*a* having the shape of a segment of a crown, extending on a portion of the height of the cam 7. The lever 12, which is arranged so as to pass under this protrusion 4*a*, is also provided with a crown shaped segment, designated by 12*c*, which is applied against the protrusion 4*a* of the wheel 4 when the cam is stationary and when the arms 12*a* and 12*b* of the lever cap the circular portion 7*b* of the cam. The protrusion 4*a*, while sliding on the braking shoe constituted by the protrusion 12*c* of the lever 12 (FIGS. 3 and 4), produces a friction which prevents any floating of the gearing.

What I claim is:

1. An improved calendar electro-mechanic timepiece including a movement gearing and a driving mechanism for at least one calendar indicating member, said driving mechanism including intermittent rotating means for intermittently driving said calendar indicating member and torque generating means for preventing floating of said movement gearing when said drive means is rotating, said improvement comprising:

brake means for generating torque for preventing floating of said movement gearing when said drive means is not rotating, said brake means cooperating with said driving mechanism to sychronise operation of said torque generating means and said brake means.

2. An improved timepiece as claimed in claim 1 wherein:

said driving mechanism includes a wheel making one revolution per predetermined time period, said wheel driving a cam by means of a surprise mechanism causing said cam to move independently from said wheel once per revolution in advance on said wheel, said cam operating a control lever biased against said cam by a spring, said cam including a protrusion which bears against said control lever as said cam rotates, said lever after passing over said protrusion moves said cam forward on said driving wheel in an instantaneous step during which a control finger, rigid with said cam drives said calendar indicating member, said brake means including a braking member rigid with said wheel which bears against said lever when said cam is not rotating.

3. An improved timepiece as claimed in claim 2 wherein:

said braking member includes a crown shaped protrusion segment integral with said driving wheel and extending from a face of the wheel against which is applied said cam.

4. An improved timepiece as claimed in claim 2 wherein:

said cam has the shape of a circular disc with an ear shaped portion on one side thereof, one end of said ear forming said cam protrusion, said control lever including a fork shaped portion by means of which it caps the circular disc portion of said cam, said fork shaped portion including arms which bear against said cam ear once revolution of said cam.

5. An improved timepiece as claimed in claim 4 wherein:

said braking member includes a crown shaped protrusion segment integral with said driving wheel which extends from said driving wheel to a height only a portion of the height of said cam, said fork shaped portion of said control lever passing under said protrusion for operating against said cam, said lever including a crown shaped protrusion which constitutes said braking member forming a braking shoe which bears against the protrusion of said driving wheel when said cam does not cooperate with said lever.

* * * * *